US005806382A

United States Patent [19]

Hall, Jr.

[11] Patent Number: 5,806,382

[45] Date of Patent: Sep. 15, 1998

[54] WRENCH FOR WIRE NUTS

[76] Inventor: Wayman Hall, Jr., 614 Apache Trail, Woodstock, Ga. 30189

[21] Appl. No.: 848,959

[22] Filed: May 1, 1997

[51] Int. Cl.[6] ..... B25B 13/52

[52] U.S. Cl. ..... 81/64; 81/125

[58] Field of Search ..... 81/64, 120, 121.1, 81/125, 125.1, 3.43; 7/107

[56] References Cited

U.S. PATENT DOCUMENTS

| | | | |
|---|---|---|---|
| 2,719,451 | 10/1955 | Peters | 84/312 |
| 2,805,590 | 9/1957 | Nelson | 81/3 |
| 2,959,995 | 11/1960 | Linden | 81/120 |
| 2,966,083 | 12/1960 | Cheney | 81/90 |
| 3,269,226 | 8/1966 | Von Tersch | 81/64 |
| 3,641,846 | 2/1972 | Prial | 81/90 |
| 3,787,948 | 1/1974 | Runge | 81/121.1 |
| 4,860,618 | 8/1989 | Givot | 81/125.1 |
| 5,060,995 | 10/1991 | Goldstein et al. | 294/19.1 |

FOREIGN PATENT DOCUMENTS

| | | | |
|---|---|---|---|
| 2138245 | 2/1972 | Germany | 81/125 |

*Primary Examiner*—David Scherbel
*Assistant Examiner*—Joni B. Danganan
*Attorney, Agent, or Firm*—Isaf, Vaughan & Kerr

[57] ABSTRACT

A wire end connector tool designed for use with a standard wire connector cap for crimping the ends of wires together. The tool consists of a cylindrical handle of a thickness to fit comfortably in a user's hand and an axial member, longer than the handle, rotationally captured in and extending through the cylindrical handle and able to rotate therein. One or both ends of the axial member protrude from the end(s) of the cylindrical handle. Each protruding end is formed into a helical coil with its axis parallel to, but spaced from, the axis of the handle. Each coil is designed to securely accept standard wire connector caps such as those described above and to prevent it from rotating. This allows wires to be connected with a simple wrist rotation rather than requiring manual twisting with the fingers.

5 Claims, 2 Drawing Sheets

WRENCH FOR WIRE NUTS

FIELD OF THE INVENTION

This invention relates generally to electrician's tools. More particularly, this invention relates to a tool for quickly and easily securing free ends of electrical wires together, even those located in relatively narrow areas, with a minimum of user effort.

BACKGROUND OF THE INVENTION

When an electrician needs to secure two wire ends together to form a circuit, the electrician generally first places the two free ends into a wire connector cap and, utilizing wrist action, twists the cap thus causing the wire ends to twist together. The cap is left in place to further secure the connection. This process requires that the electrician's hand be virtually in the same place as the cap which may be very difficult to accomplish when, for example, the connection is being made in a relatively confined space. Further, the torque required to twist the wire ends together comes primarily from the electrician's fingers which can possibly result in injury to the fingers or hand if a large number of connections must be made.

One early approach to solve the aforementioned problems is the device described in U.S. Pat. No. 2,966,083 of Cheney, which discloses a wrench for engaging and disengaging pigtail connectors such as the ones used on the ends of stripped electrical wire. This device consists of a base in the form of an annular flange and two arms protruding therefrom. Actual gripping of the connector is accomplished with grooves within the flange. A similar device is disclosed in U.S. Pat. No. 2,959,995 of Linden. Linden discloses a wire-connector wrench for use by electricians for engaging and disengaging pigtail connectors. The wrench disclosed in Linden has a one piece, die-cast body with two coaxial sockets. Wire-connector ends appear to fit into the sockets, where grooving on the socket walls meshes with the knurling and thereby allows a twist to be applied, thus securing the connection.

While both Cheney and Linden teach the use of a specialized wrench for engaging and disengaging wire connectors, these wrenches are generally flat and primarily designed to fit within a user's hand.

U.S. Pat. No. 2,805,590 of Nelson discloses a tool for installing or extracting electronic tubes. This invention essentially consists of a helical coil spring, the length of which is divided into segments of different diameters, with the intermediate segment narrower than the end segments. The coils are configured to slip over and grip the tube, allowing the user, for example, to remove the tube from an electronic device. One end segment is larger, for use with larger tubes, and the opposite end segment is smaller, for use with smaller tubes. Nelson teaches the use of a helical-coil gripping surface, however, it fails to disclose mounting the coils to a fixed handle and it is unlikely that this design could provide sufficient torque to securely connect two wire ends.

U.S. Pat. No. 3,269,226 of Von Tersch discloses a wrench employing a spiral spring for encircling and grasping cylindrical objects. This device is configured to increase its grip on an object when rotated in one direction and decrease the grip when rotated in the other direction. Although Von Tersch discloses a wrench which utilizes a helical-coil, this device is designed to grip solid cylindrical objects only and is not constructed for use in fastening free wire ends together.

A need exists, therefore, for a tool which allows an electrician to quickly and easily connect two wire ends together without using his or her fingers alone to supply the required torque. Moreover, a need exists for a tool which allows an electrician to connect wire ends located in relatively confined spaces into which it would be difficult for the electrician to reach or otherwise extend his or her hands.

SUMMARY OF THE INVENTION

The present invention provides an improved electrician's tool which overcomes a number of design deficiencies present in other wire connector tools known in the art. The improved electrician's wire end connector tool of this invention is designed for use with a standard wire connector cap for crimping the ends of wires together. The wire connector caps have a body with a pair of opposed wing tabs on either side. The interior of the cap is designed in known fashion with sufficient room to allow two wire ends to enter therein but not enough room for them to rotate freely once inside. Thus, a torque applied to the cap causes the wire ends to twist and become thicker thereby securing them inside the cap.

The improved electrician's tool disclosed herein has a cylindrical handle of a thickness sized to fit comfortably in a user's hand. An axial member, longer than the cylindrical handle, extends through the cylindrical handle and is rotationally captured within the handle. One end, or both ends of the axial member protrude from the respective end or ends of the cylindrical handle. Each protruding end is bent approximately ninety degrees away from the axis of the cylindrical handle. In the embodiment of the invention in which both ends of the axial member protrude from the handle, the two protruding ends are offset approximately one-hundred eighty degrees from one another.

Each protruding end of the axial member is formed into a helical coil sized and shaped to securely accept standard wire connector caps therein, such as those described above, and to prevent the connector cap from rotating within the coil. Each helical coil is parallel to, and offset from, the axis of the cylindrical handle. The present invention allows a user to access wires in tight areas where the entire hand would not comfortably fit.

Accordingly, it is an object of the present invention to provide an improved electrician's tool for joining the free ends of wires together within a wire connector cap.

Another object of the present invention is to provide an improved electrician's tool that is easy to use, durable, and inexpensive.

Another object of the present invention is to provide an improved electrician's tool that fits comfortably in the user's hand.

It is yet another object of the present invention to provide a tool that readily allows a user to access and connect wire ends which are in narrow confined spaces.

DETAILED DESCRIPTION OF THE INVENTION

Figure 1:
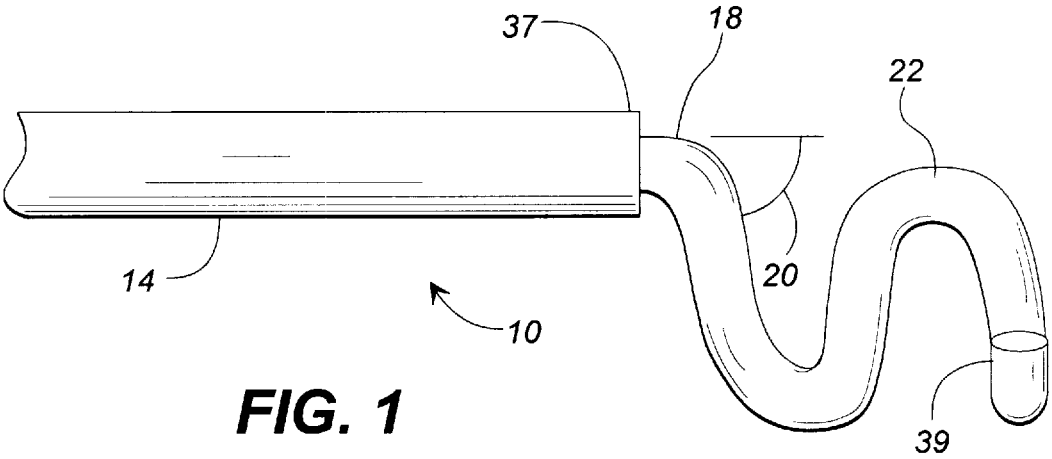
FIG. 1 is a partial side elevational view of an electrician's tool for use with a wire connector cap.

Referring now in detail to the drawings, in which like reference numerals represent like parts throughout the several views, numeral 10 of FIG. 1 represents an electrician's tool having a hollow cylindrical handle 14 (FIG. 2) with a rotationally captured axial member 18, a length of which extends from the end of hollow cylindrical handle 14. The protruding ends of rotationally captured axial member 18 form an angle 20 of approximately ninety degrees with the axis of hollow cylindrical handle 14 at the end of hollow cylindrical handle 14. The distal end 39 of rotationally captured axial member 18 is formed as a helical coil 22 having a central axis 23 generally parallel to hollow cylindrical handle 14. Helical coil 22 is designed and configured to securely receive wire connection cap 24 (shown in outline) and prevent rotation thereof by grasping the opposed wing tabs 38 extending outwardly from the body 34 of the cap.

Figure 2:
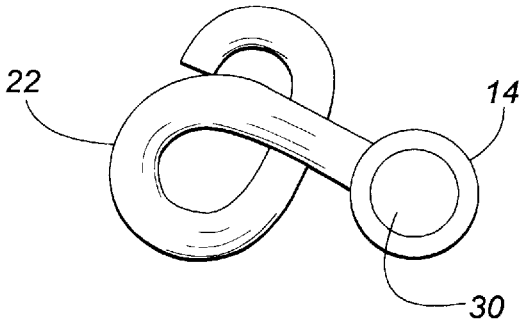
FIG. 2 is an end elevational view of an electrician's tool showing the hollow central channel.

Referring to FIG. 2, a cross sectional end view of hollow cylindrical handle 14 rotationally captured axial member 18 contained therein is depicted. Passageway 30 is contained axially within hollow cylindrical handle 14 and is sized to accept rotationally captured axial member 18. The radius of rotationally captured axial member 18 is sufficiently smaller than that of passageway 30 to allow rotationally captured axial member 18 to rotate therein.

Figure 3:
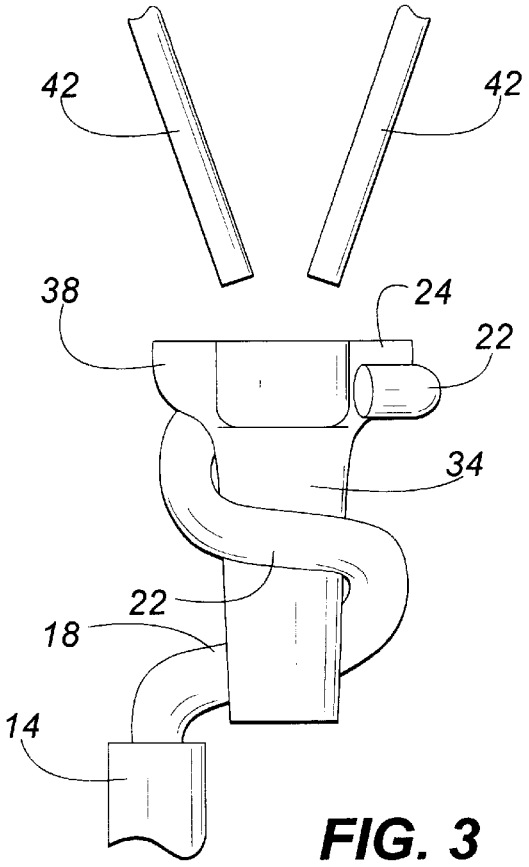
FIG. 3 is a schematic view of a wire connector cap secured within a helical coil formed at the end of the tool of FIG. 1 and of two unconnected wire ends to be joined together.

FIG. 3 shows the invention as it would be used. The end 37 of hollow cylindrical handle 14 is shown with rotationally captured axial member 18 extending therefrom. Helical coil 22 is depicted with a wire connector cap 24 secured therein. Wire connector cap 24 is a standard wire connector cap well known to those skilled in the art. Wire connector cap 24 includes wing tabs 38 which extend away from body 34, one of which is engaged by the distal end 39 of helical coil 22 thereby preventing wire connector cap 24 from freely rotating. Separate wire ends 42 are illustrated. Wire connector cap 24 is positioned with wire ends 42 inside of it. The user then quickly rotates hollow cylindrical handle 14 which in turn forces wire connector cap 24 to rotate causing wire ends 42 to twist together. Wire connector cap 24 is designed to prevent the twisted wire ends from exiting, typically by having a thread (not shown) defined along the inner circumferential surface thereof, allowing the user to retract or withdraw tool 10 causing wire connector cap 24 to pull free of helical coil 22 while wire ends 42 remain fastened within the cap.

Figure 4:
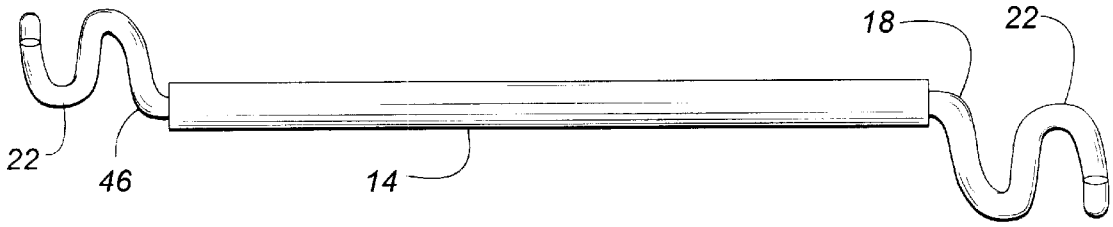
FIG. 4 is a side elevational view of an alternative embodiment of an electrician's tool with which a wire connector cap can be secured in either end of the tool.

FIG. 4 depicts an alternate embodiment of an electrician's tool 10. In this embodiment rotationally captured axial member 18 extends from both ends of hollow cylindrical handle 14. Again, rotationally captured axial member 18 is bent at an angle 20 of approximately ninety degrees on one side of hollow cylindrical handle 14 and is bent into an angle 46 of approximately ninety degrees, diametrically opposed to angle 20. In this configuration electrician's tool 10 could be designed to accommodate two wire connection caps of the same size, one at each end of hollow cylindrical handle 14, or wire connection caps of different sizes, if so desired.

While preferred embodiments of the invention have been disclosed in the foregoing specification, it will be understood by those skilled in the art that variations and modifications thereof can be made without departing from the spirit and scope of the invention as set forth in the following claims. In addition, the corresponding structures, materials, acts, and equivalents of all means or step plus function elements in the claims below are intended to include the structure, material, or acts for performing the function in combination with other claimed elements, as specifically claimed herein.

What is claimed is:

1. A wire end connector tool for use with a wire connector cap for crimping the ends of wires together, the wire connector cap having a body with a pair of opposed wing tabs extending transversely away therefrom, said tool comprising:

an elongate hollow cylindrical member of a first length, said cylindrical member having a first end and a spaced second end:

an elongate axial member of a second length greater than the first length of said cylindrical member, said axial member having a first end and a spaced second end and being extended axially through said cylindrical member and rotationally captured therein, at least one of the first and second ends, respectively, of said axial member protruding from the respective end(s) of the said cylindrical member;

the first end of said axial member extending away from the first end of said cylindrical member at a first angle with respect thereto;

wherein the end of said axial member is sized and shaped as a helical coil constructed and arranged to releasably grasp one of the wing tabs of the wire connector cap therein, said helical coil being spaced from and parallel to said cylindrical member.

2. A wire end connector tool as described in claim 1, wherein said cylindrical member is designed and configured to fit comfortably in a user's hand.

3. A wire end connector tool as described in claim 1, wherein said first angle is approximately ninety degrees.

4. A wire end connector tool as described in claim 1, wherein the radius of said axial member is small relative to the radius of said hollow cylindrical member.

5. A wire end connector tool for use with a wire connector cap for crimping the ends of wires together, the wire connector cap having a body with a pair of opposed wing tabs extending transversely away therefrom, said tool comprising an elongate hollow cylindrical member of a first length, said cylindrical member having a first end and a second end, and an axial member, longer than said cylindrical member, extending axially through said cylindrical member and rotationally captured therein, said axial member having a first end protruding from said first end of said cylindrical member and a second end protruding from said second end of said cylindrical member, said first end of said axial member bent approximately ninety degrees away from said first end of said cylindrical member and said second end of said axial member bent approximately ninety degrees from said second end of said cylindrical member but offset approximately one-hundred eighty degrees from said first end of said axial member, said first and second ends of said axial member being further formed into helical coils, designed and configured to securely accept standard wire connector caps and prevent rotation thereof, said helical coils being placed parallel to, but offset from, said cylindrical member.

* * * * *